US007681651B2

(12) United States Patent
Loughlin

(10) Patent No.: US 7,681,651 B2
(45) Date of Patent: Mar. 23, 2010

(54) DOWNHOLE BRIDGE PLUG OR PACKER SETTING ASSEMBLY AND METHOD

(75) Inventor: Michael J. Loughlin, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 268 days.

(21) Appl. No.: 11/688,659

(22) Filed: Mar. 20, 2007

(65) Prior Publication Data

US 2008/0230235 A1 Sep. 25, 2008

(51) Int. Cl.
*E21B 33/12* (2006.01)

(52) U.S. Cl. ..... 166/387; 166/106; 166/187; 166/192

(58) Field of Classification Search ..... 166/383, 166/387, 101, 68, 106, 187, 192
See application file for complete search history.

(56) References Cited

U.S. PATENT DOCUMENTS

| | | | | |
|---|---|---|---|---|
| 4,493,374 | A * | 1/1985 | Magee, Jr. | 166/382 |
| 4,535,842 | A | 8/1985 | Ross | |
| 5,228,519 | A * | 7/1993 | Coronado et al. | 166/387 |
| 6,896,049 | B2 | 5/2005 | Moyes | |
| 7,172,028 | B2 * | 2/2007 | Barbee et al. | 166/383 |

OTHER PUBLICATIONS

King, James. "Cost and Risk Reduction Through Innovation: remotely Actuated Completion Equipment for Deepwater and Extended Reach Wells," SPE 68763. Society of Petroleum Engineers, Jakarta, Indonesia, Apr. 17-19, 2001, 6 pages.

King, James. "Remote Actuation Systems for Setting Completion Tools Work at Ultra-Depths," Offshore Magazine Online, Oct. 1, 2001, 4 pages. Retrieved online on Sep. 17, 2008 from : http://www.offshore-mag.com/articles/article_display.cfm?ARTICLE_ID=126454&p=p.

King, James, "Interventionless Actuated Completions Reduce Risks, Costs," Oil & Gas Journal, Oct. 13, 2002, 8 pages. Retrieved online on Sep. 17, 2008 from: http://www.ogj.com/articles/article_display.cfm?ARTICLE_ID=189489&p=7.

Hydraulic-Set Wizard III Packer, Completion Tools, Halliburton. H04583, Jun. 2006. 2 pages.

Versa-Set Retrievable Packer, Completion Tools, Halliburton, H03065, Jun. 2005. 2 pages.

Quantum Short-Catch Packer Plug with Mandrel Saver, Schlumberger, SC_03_054_0, Nov. 2003. 1 page.

Omega: Omega Hydrostatic Setting Tool, Omega Completion Technology, Ltd. Copyright 2001. 2 pages.

* cited by examiner

*Primary Examiner*—David J Bagnell
*Assistant Examiner*—Cathleen R Hutchins
(74) *Attorney, Agent, or Firm*—Cantor Colburn LLP

(57) ABSTRACT

Disclosed herein is a method of elongating a setting time of a bridge plug or packer. The method includes, positioning the bridge plug or packer in a desired position within a wellbore, partially setting the bridge plug or packer with a first hydraulic pressure, controlling remotely a rate of application of a second hydraulic pressure, and completing the setting of the bridge plug or packer with the second hydraulic pressure, the second hydraulic pressure being greater than the first hydraulic pressure.

23 Claims, 3 Drawing Sheets

DOWNHOLE BRIDGE PLUG OR PACKER SETTING ASSEMBLY AND METHOD

BACKGROUND OF THE INVENTION

Downhole bridge plugs and packers are well known in the industry, each having been extensively used over a substantial number of years. Each type of device includes a seal member and each generally includes an anchoring arrangement. The seal and the anchoring arrangement each have to be set for the device to work properly. While bridge plugs and Packers are distinct devices, at a conceptual level many are similar. With respect to the method disclosed in this application, they are nearly the same as the method works equivalently for both. For the sake of simplicity then, reference will be made to "Packers" hereinafter, but it will be understood that both are intended. Locationally fixing (anchoring) the packer to the wellbore is typically accomplished with a plurality of slips. In some packers the slips start as a slip ring mounted around a conical member. As the packer is actuated the slip ring is forced axially over a conical member thereby breaking the slip, at designated fracture points, into a plurality of slips. The plurality of slips wedge between the packer and an inside surface of the wellbore. Sealing of the packer within the wellbore is typically accomplished with at least one sealing element. The at least one sealing element, when actuated, expands radially outwardly to sealingly engage with the inner surface of the wellbore. The slips and the sealing elements of a packer are commonly actuated relatively simultaneously.

As such, once actuation of a packer is initiated the process continues until the actuation of both the slips and the at least one sealing element is completed. There are a variety of triggers used to initiate actuation of a packer that are well known in the industry.

Also common in the industry are hydrostatic setting tools also known as actuators. Hydrostatic setting tools use hydrostatic pressure available downhole to drive the actuation and setting of the slips and the at least one sealing element. Such systems are known in the industry an example of which is described in U.S. Pat. No. 4,353,842, which is incorporated herein in its entirety by reference. As described in U.S. Pat. No. 4,353,842 fluid under hydrostatic pressure urges movement of an actuator that actuates the slips and the at least one sealing element.

In order to control a rate of actuation in the packer it is common to employ mechanisms to slow the setting of the slips and actuation of the at least one sealing element. Some such systems employ a fluid metering system to control the rate porting the fluid through small orifices. These metering systems slow the setting of the packer somewhat, but not as much as may be desired to optimize the seating and longevity of the sealing element. Additionally, the timing of the metering system is set prior to running the apparatus downhole and as such is not receptive to changes that may be desirable upon changing well formation conditions.

Accordingly, the art may be receptive to simple downhole packers that have controllable setting rates.

BRIEF DESCRIPTION OF THE INVENTION

Disclosed herein is a method of elongating a setting time of a bridge plug or packer. The method includes, positioning the bridge plug or packer in a desired position within a wellbore, partially setting the bridge plug or packer with a first hydraulic pressure, controlling remotely a rate of application of a second hydraulic pressure, and completing the setting of the bridge plug or packer with the second hydraulic pressure, the second hydraulic pressure being greater than the first hydraulic pressure.

Further disclosed herein is a downhole bridge plug or packer setting assembly. The assembly includes, a bridge plug or packer, a hydraulic setting tool in operable communication with the bridge plug or packer capable of partially setting the bridge plug or packer and incapable of completely setting the bridge plug or packer with hydrostatic pressure supplied thereto, and a slow remotely driven pressure-building device in operable communication with the setting tool capable of supplying pressure greater than hydrostatic pressure to the setting tool.

Further disclosed herein is a downhole bridge plug or packer setting tool. The tool includes a piston assembly in operable communication with at least one settable seal of a downhole bridge plug or packer and a cylinder assembly in operable communication with the piston assembly. The cylinder assembly is also in operable communication with a remotely driven movable member such that the cylinder assembly is movable relative to the piston assembly in response to movement of the remotely driven moveable member relative to the piston assembly, and movement of the cylinder assembly relative to the piston assembly causes fluid to be expelled from the piston assembly to the downhole bridge plug or packer to thereby set the settable seal. Additionally, the fluid expelled from the piston assembly during movement of the cylinder assembly is in a direction that is opposite to a direction of the movement of the cylinder assembly.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of an embodiment of the disclosed apparatus and method are presented herein by way of exemplification and not limitation with reference to the Figures.

An embodiment of the downhole bridge plug or packer setting assembly disclosed herein allows a well operator to control a rate of actuation at which to complete the setting of the packer. As such, an operator can dramatically slow the rate of completion of the setting after initiation of the setting. Controlling the rate of setting of the seal improves the durability of the seal by allowing the elastomer time to flow into the particular shape of the volume within which it is to seal.

Figure 1:
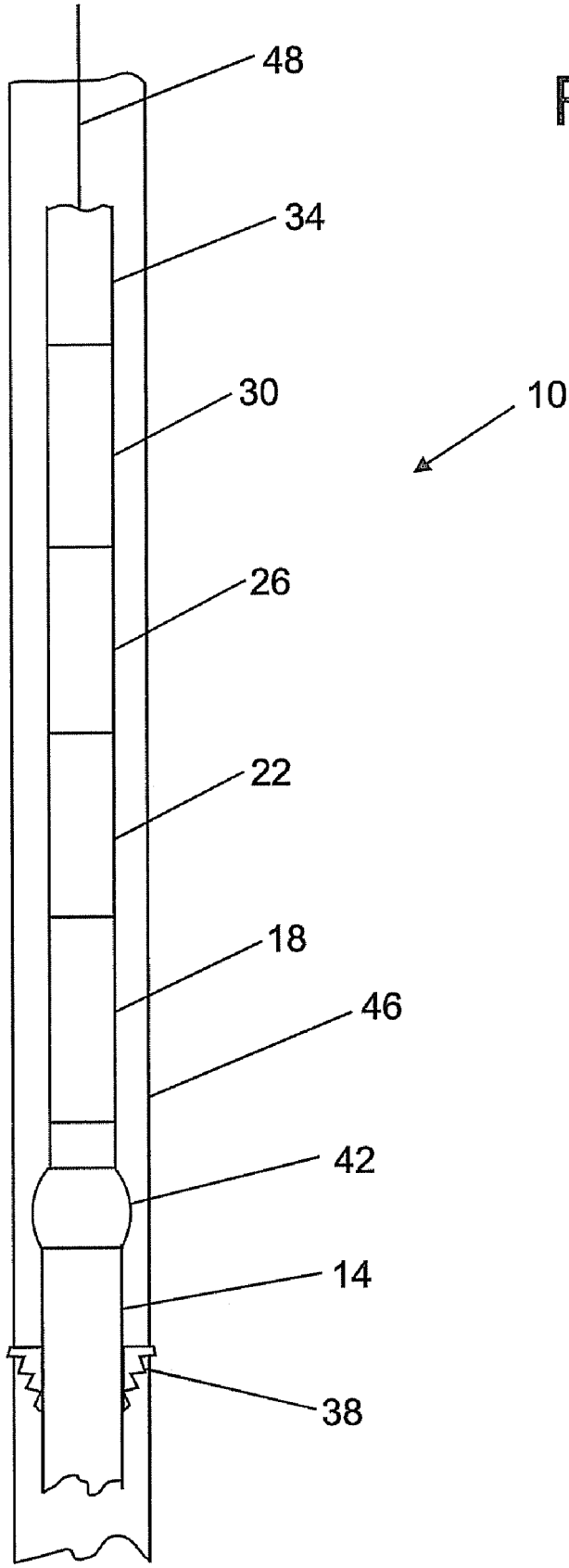
FIG. 1 depicts a downhole bridge plug or packer setting assembly disclosed herein.

Referring to FIG. 1, an embodiment of the downhole bridge plug or packer setting assembly 10 disclosed herein is illustrated. The packer setting assembly 10 includes a bridge plug or packer 14, a wireline adapter kit 18, a setting tool 22, a trigger 26, a pressure building device 30, illustrated herein as a pump, and an optional fluid-compensating reservoir 34. The packer 14 further includes a plurality of slips 38 (that together make up a slip ring prior to fracturing of the slip ring that occurs during actuation) and one or more sealing elements 42. Through conventional means, the trigger initiates actuation of the setting tool 22, which in this embodiment, causes fluid, at hydrostatic pressure, to flow into the setting tool 22. This pressurized fluid energizes the setting tool 22 that is in operational communication with the packer 14, and thus begins actuation of the packer 14. Such actuation includes fracturing of a slip ring into a plurality of slips 38 and axial movement of the slips 38 to engage with a wellbore 46. The forces transferred from the setting tool 22 to the packer 14 are set to be able to achieve a sufficient magnitude to fracture the slip ring and set the slips 38 (cause the slips 38 to engage with the wellbore 46) but not sufficient to actuate a release member whose release is necessary to set the seal. In the vernacular such is termed "part-the-stud." It is necessary, as noted, to "part-the-stud" before the sealing elements 42 can be actuated to engage with and seat to the wellbore 46. In this embodiment, a greater pressure, than that supplied hydrostatically downhole, is necessary, to "part-the-stud" and set the sealing elements 42.

The pump 30 is employed to build pressure above the hydrostatic pressure in order to "part-the-stud" and fully set the sealing elements 42 with the wellbore 46. In this embodiment, movement of a wireline or slickline 48 initiates and drives the pump 30. The wireline 48 is connected to surface and as such can be pulled in an uphole direction and run in a downhole direction. Uphole and downhole reciprocation of the wireline 48 causes the pump 30, as will be described in detail with reference to FIG. 2 below, to increase pressure of fluid that is supplied to the setting tool 22 by the pump 30. It is, therefore, through controlling the reciprocation rate of the wireline 48 that the rate of actuation is controlled remotely. It is this higher pressure that actuates the at least one sealing element 42 of the packer 14. It should be noted that although movement of the wireline or slickline 48 actuates one embodiment described herein of the pump 30, alternate embodiments could use other pressure-building devices as the pump 30, and such an alternate pressure-building device could be driven by other than movement of a wireline or slickline 48. For example, an alternate embodiment could have a pressure-building device that employs a screw, and the screw could be driven by rotational motion provided through a tubular in communication with the surface.

The trigger 26 can be any of a variety of types known in the industry such as a timer type, either electrical or mechanical, a control line actuated type, or a hydrostatic pressure actuated type, for example. The trigger 26, upon triggering, initiates actuation of the setting tool 22 by opening a port to allow fluid at hydrostatic pressure to enter the setting tool as described above.

The one or more sealing elements 42 of this embodiment are actuated by pressurization of fluid by the pump 30. The one or more sealing elements 42 can be of a conventional type, which through axial compression of an elastomeric member cause an increase in a radial dimension of the elastomeric member so that it sealingly engages with an inner dimension of the wellbore 46. In this case the setting tool 22 causes relative axial motions of components within the packer 14 to compress the conventional sealing elements 42. Alternately, the one or more sealing elements 42 can be of the inflatable type. Inflatable type sealing elements 42 utilize pressurized fluid such as hydraulic fluid stored within the setting tool 14 to inflate the one or more sealing elements 42. Inflation of the sealing elements 42 causes a portion of the sealing elements 42 to radially increase such that they sealingly engage with an inner dimension of the wellbore 46.

Figure 2A:
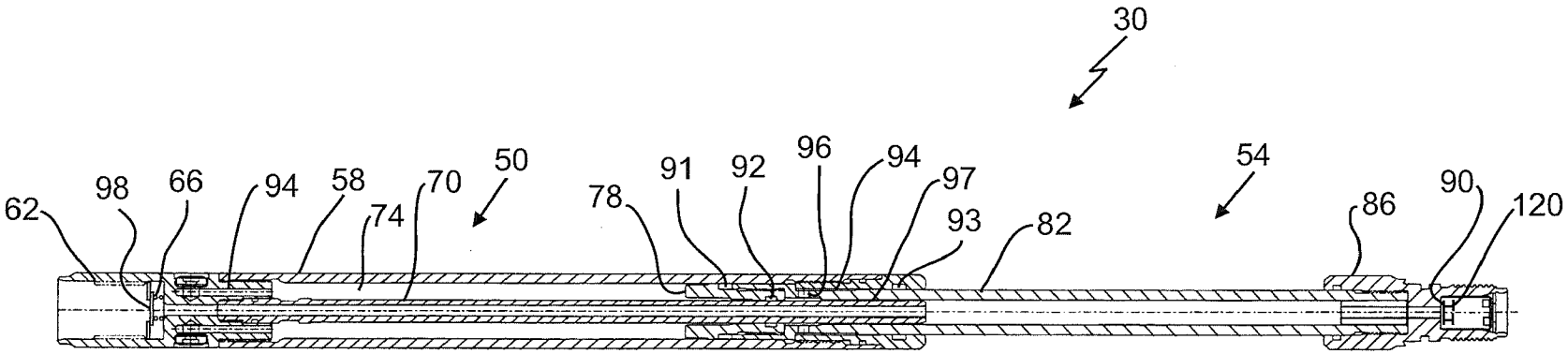
FIG. 2A depicts a pressure-building source shown in the downhole bridge plug or packer setting assembly of FIG. 1, in a ready-to-pump position.
Figure 2B:
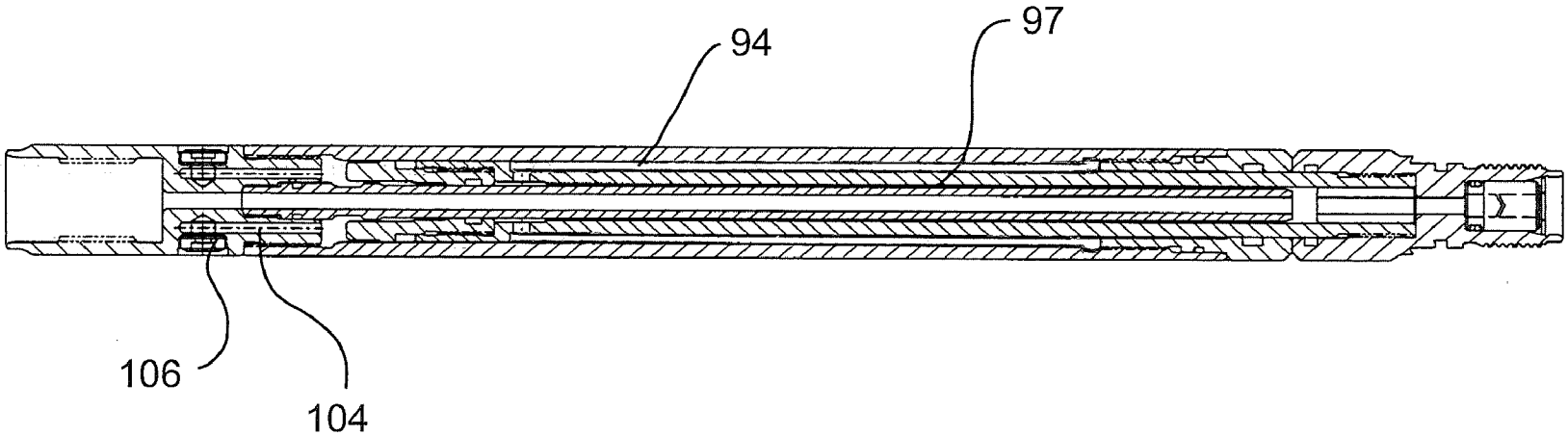
FIG. 2B depicts the pressure-building source of FIG. 2A in a ready-to-suck position.

Referring to FIGS. 2A and 2B, an embodiment of the pump 30, disclosed herein, is illustrated in a ready-to-pump position in FIG. 2A and a ready-to-suck position in FIG. 2B. The pump 30 includes a cylinder assembly 50 and a piston assembly 54 that are moveable relative to one another. The cylinder assembly 50 has a cylinder 58 sealedly attached to a top sub 62 that has a one-way inlet check valve 66 housed therein. The top sub 62 also is sealedly attached to a flow tube 70. The piston 78 is sealedly attached to a piston rod 82 that is sealedly attached to a bottom adapter 86, which houses a discharge check valve 90. Three seals 91, 92, 93 seal the cylinder assembly 50 to the piston assembly 54 while allowing the two assemblies 50, 54 to move axially relative to one another. The first seal 91 seals the piston 78 to the cylinder 58, the second seal 92 seals the cylinder to the piston rod 82, and the third seal 93 seals the piston 78 to the flow tube 70. The three seals 91, 92, 93 isolate an annular cavity 94 between the cylinder 58 and the piston rod 82 that changes in volume as the assemblies 50, 54 move axially relative to one another. At least one port 96 fluidically connects the annular cavity 94 to an annular space 97 between the piston rod 82 and the flow tube 70. As such, axial movement of the cylinder assembly 50 away from the piston assembly 54 causes the volume of the annular cavity 94 to decrease forcing any fluid contained therein to flow through the at least one port 96, through the annular space 97, through the discharge check valve 90 and out through the bottom adapter 86. This pumped fluid is ported to the setting tool 22 thereby increasing the pressure to the setting tool 22 above a pressure available hydrostatically.

The suction check valve 66 and the discharge check valve 90 work in unison during the pumping action of the pump 30. During a pressure stroke of the pump 30, pressurized fluid is forced out of the annular cavity 94 and is forced out through the discharge check valve 90 while being prevented from flowing out through the closed suction check valve 66. The suction check valve 66 is closed due to the pressure of the fluid that urges the suction check valve 66 toward a closed position and by an optional spring 98 that biases the suction check valve 66 toward a normally closed position. Conversely, during a suction stroke of the pump 30, suction is created as the volume of the annular cavity 94 increases due to the relative motion of the cylinder assembly 50 away from the piston assembly 54. During the stroke, fluid is prevented from flowing in through the closed discharge check valve 90. The discharge check valve 90 is closed due to the differential pressure across the discharge check valve 90 created by the suction within the pump 30 and by an optional spring 102 that biasing the discharge check valve 90 towards a normally closed position. In this condition fluid is sucked in through the suction check valve 66 by the differential pressure across the suction check valve 66 generated by the suction within the pump 30.

Through selection of particular design parameters of the foregoing components of the pump 30 the volume of fluid pumped during each stroke of the pump 30 can be precisely set to any desired volume. By setting the volume plumped per stroke to a small value the rate of setting of the packer 14 can be controlled at a very slow rate. Setting the packer 14 at a slow rate has advantages of seal durability as discussed above.

At least one venting port 104, with a filter 106 thereat, fluidically connects an annular volume 110 to the fluid of the wellbore 46. The piston 78 vacates the annular volume 110, between the cylinder 58 and the flow tube 70, as the cylinder assembly 50 is moved away from the piston assembly 54. The at least one venting port 104 permits fluid to flow freely to and from the wellbore 46 and the annular volume 110 as the piston 78 is moved out of and into the annular volume 110. This venting of fluid is necessary to prevent hydraulically locking the assemblies 50, 54 to one another.

The wireline 48 is connected to the cylinder assembly 50 such that when the wireline 48 is pulled toward the surface the cylinder assembly 50 is also moved toward the surface. Conversely, as the wireline 48 is let out from the surface the cylinder assembly 50 is able to drop in a downhole direction due to the weight of the piston assembly 54 and other components of the packer setting assembly 10 attached thereabove. Thus, through repeated manipulations of the wireline 48, in uphole and downhole directions, the pump 30 is reciprocated. This reciprocating action results in the pumping of fluid that is ported to the setting tool 22 to facilitate completion of actuation of the slips 38, if such completion was not attained earlier, and setting of the one or more sealing elements 42.

With the foregoing structure the packer setting assembly 10 disclosed herein is able to control both a rate and timing of completion of the packer 14. More specifically, the rate of setting of the one or more sealing elements 42 can be controlled totally independently from the setting of the one or more slips 38. Such control is possible since the anchoring of the packer 14 to the wellbore 46 is at least partially completed by the hydrostatic fluid pressure, thereby preventing movement of the packer 14 relative to the wellbore 46. As such, subsequent movement of the wireline 48 undertaken to complete the setting of the one or more sealing elements 42 does not cause the packer 14 to move relative to the wellbore 46.

Fluid can be sucked into the pump 30 from a few different sources. For example, the, optional, fluid-compensating reservoir 34 may be employed. The reservoir 34, if employed, is fluidically connected to the top sub 62 such that suction from the pump 30 sucks fluid from the reservoir 34 into the pump 30 through the suction check valve 66. Whether or not to employ the reservoir 34 may be decided upon based on the availability of suitable fluid in the downhole location where the packer setting assembly 10 will be deployed. If suitable fluid is available in the downhole location wherein the packer setting assembly 10 will be deployed it may be sucked into the pump 30 from the wellbore 46 directly. In such an embodiment wellbore fluid would be ported from the wellbore 46 to the top sub 62 through a filter (not shown), for example.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A method of elongating a setting time of a bridge plug or packer, comprising:

positioning the bridge plug or packer in a desired position within a wellbore;

developing a first hydraulic pressure with hydrostatic pressure;

partially setting the bridge plug or packer with the first hydraulic pressure;

generating a second pressure with a hydraulic pump;

controlling remotely a rate of application of the second hydraulic pressure; and completing the setting of the bridge plug or packer with the second hydraulic pressure, the second hydraulic pressure being greater than the first hydraulic pressure.

2. The method of elongating the setting time of a bridge plug or packer of claim 1, further comprising positionally fixing the bridge plug or packer to a position within the wellbore with the partial setting of the bridge plug or packer.

3. The method of elongating the setting time of a bridge plug or packer of claim 1, further comprising:

partially setting at least one seal of the bridge plug or packer with the first pressure; and completing the setting of the at least one seal with the second pressure.

4. The method of elongating the setting time of a bridge plug or packer of claim 1, wherein the generating of the second pressure further comprising reciprocating the hydraulic pump with a wireline or slickline in operable communication with the surface.

5. The method of elongating the setting time of a bridge plug or packer of claim 4, wherein the generating of the second pressure further comprising controlling a rate of pressure generation through control of movement of the wireline or slickline in operational communication with the hydraulic pump.

6. The method of elongating the setting time of a bridge plug or packer of claim 1, further comprising expelling fluid from a first longitudinal end of the pump in response to movement of a portion of the pump in a direction away from the first longitudinal end of the pump.

7. The method of elongating the setting time of a bridge plug or packer of claim 1, further comprising expelling fluid from the pump in a downhole direction in response to a portion of the pump moving in an uphole direction.

8. The method of elongating the setting time of a bridge plug or packer of claim 1, wherein the generating of the second pressure further comprising generating a greater pressure than the hydrostatic pressure.

9. A downhole bridge plug or packer setting assembly, comprising:

a bridge plug or packer;

a hydraulic setting tool in operable communication with the bridge plug or packer capable of partially setting the bridge plug or packer and incapable of completely setting the bridge plug or packer with hydrostatic pressure supplied thereto; and a slow remotely driven pressure-building device in operable communication with the setting tool capable of supplying pressure greater than hydrostatic pressure to the setting tool.

10. The downhole bridge plug or packer setting assembly of claim 9, further comprising a trigger in operable communication with the setting tool.

11. The downhole bridge plug or packer setting assembly of claim 9, wherein the setting tool with hydrostatic pressure is capable of setting at least one slip of the bridge plug or packer and is incapable of completely setting at least one sealing element of the bridge plug or packer.

12. The downhole bridge plug or packer setting assembly of claim 9, wherein the slow remotely driven pressure-building device at least one pump.

13. The downhole bridge plug or packer setting assembly of claim 12, wherein at least one slip positionally locks the downhole bridge plug or packer setting assembly to a wellbore during actuation of the at least one pump.

14. The downhole bridge plug or packer setting assembly of claim 12, wherein the at least one pump is a reciprocating pump.

15. The downhole bridge plug or packer setting assembly of claim 12, wherein movement of the at least one pump is initiated remotely.

16. The downhole bridge plug or packer setting assembly of claim 12, wherein movement of the at least one pump is through movement of a wireline or slickline.

17. The downhole bridge plug or packer setting assembly of claim 12, wherein the at least one pump expels fluid from a first longitudinal end of the at least one pump when movement of a portion of the at least one pump is toward a second longitudinal end of the at least one pump, and the first longitudinal end is on an end opposite that of the second longitudinal end.

18. The downhole bridge plug or packer setting assembly of claim 12, further comprising a reservoir from which the at least one pump draws fluid.

19. The downhole bridge plug or packer setting assembly of claim 12, wherein the at least one pump draws fluid from a wellbore.

20. The downhole bridge plug or packer setting assembly of claim 12, further comprising at least one filter for filtering fluid that the at least one pump draws.

21. A downhole bridge plug or packer setting tool, comprising:

a piston assembly;

a cylinder assembly in operable communication with the piston assembly defining a cavity therebetween, the cavity being in operable communication with a downhole bridge plug or packer; and a line attached to surface being in operable communication with at least one of the cylinder assembly and the piston assembly such that movement of the line in a direction towards surface causes movement of the one of the cylinder assembly and piston assembly in operable communication therewith to move in a same direction causing reduction in volume of the cavity and expulsion of fluid therefrom, the expulsion of fluid being in a direction opposite to that of the movement.

22. The downhole bridge plug or packer setting tool of claim 21, wherein the line is a wireline or slickline.

23. The downhole bridge plug or packer setting tool of claim 21, wherein the expulsion of fluid sets the bridge plug or packer.

* * * * *